US010607540B2

(12) United States Patent
Xi et al.

(10) Patent No.: US 10,607,540 B2
(45) Date of Patent: Mar. 31, 2020

(54) DISPLAY PANEL AND DISPLAY DEVICE

(71) Applicant: SHANGHAI TIANMA AM-OLED CO., LTD., Shanghai (CN)

(72) Inventors: Kerui Xi, Shanghai (CN); Tingting Cui, Shanghai (CN); Baiquan Lin, Shanghai (CN); Junting Ouyang, Shanghai (CN); Ruiyuan Zhou, Xiamen (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 74 days.

(21) Appl. No.: 15/917,443

(22) Filed: Mar. 9, 2018

(65) Prior Publication Data

US 2018/0197476 A1 Jul. 12, 2018

(30) Foreign Application Priority Data

Sep. 1, 2017 (CN) ..... 2017 1 0781008

(51) Int. Cl.
*G09G 3/3233* (2016.01)
*G09G 3/3208* (2016.01)

(52) U.S. Cl.
CPC ... *G09G 3/3233* (2013.01); *G09G 2300/0426* (2013.01); *G09G 2300/0819* (2013.01); *G09G 2300/0842* (2013.01); *G09G 2300/0861* (2013.01); *G09G 2310/0251* (2013.01); *G09G 2310/0262* (2013.01); *G09G 2320/0214* (2013.01); *G09G 2320/043* (2013.01)

(58) Field of Classification Search
CPC ..... H01L 29/06
See application file for complete search history.

(56) References Cited

U.S. PATENT DOCUMENTS

2004/0110331 A1* 6/2004 Yeo ..... H01L 21/82382 438/199
2012/0305893 A1* 12/2012 Colinge ..... B82Y 10/00 257/29
2012/0320004 A1* 12/2012 Kitakado ..... H01L 27/1251 345/204

(Continued)

FOREIGN PATENT DOCUMENTS

CN 102130156 A 7/2011
CN 105869573 A 8/2016

*Primary Examiner* — Sepehr Azari
(74) *Attorney, Agent, or Firm* — Alston & Bird LLP

(57) ABSTRACT

Provided are a display panel and a display device. A pixel circuit in the disclosed display panel includes a driving module, a data writing module, a storage module, and at least one control module. The data writing module is configured to write a data signal into a control terminal of the driving module. The storage module is electrically connected to the control terminal of the driving module for maintaining a voltage on the control terminal of the driving module in an emit-lighting phase. The control module is electrically connected to the control terminal of the driving module for writing a signal into the control terminal of the driving module prior to the light-emitting stage. At least one hollowed structure is provided on the continuous gate structure of the control transistor of the control module. At least one channel's width-to-length ratio is different from others among the overlapping portions' channels.

17 Claims, 11 Drawing Sheets

(56) References Cited

U.S. PATENT DOCUMENTS

| | | | | |
|---|---|---|---|---|
| 2014/0333598 | A1* | 11/2014 | Shi | G09G 3/3473<br>345/212 |
| 2016/0211313 | A1* | 7/2016 | Kim | G09G 3/3233 |
| 2016/0225836 | A1* | 8/2016 | Choi | H01L 51/0097 |
| 2016/0232849 | A1* | 8/2016 | Jeon | G09G 3/3233 |
| 2018/0122298 | A1* | 5/2018 | Lee | G09G 3/3233 |
| 2018/0151650 | A1* | 5/2018 | Ha | H01L 27/1214 |

* cited by examiner

DISPLAY PANEL AND DISPLAY DEVICE

CROSS-REFERENCE TO RELATED APPLICATIONS

This application claims priority to Chinese Patent Application No. CN201710781008.X, filed on Sep. 1, 2017 and entitled "DISPLAY PANEL AND DISPLAY DEVICE", the disclosure of which is incorporated herein by reference in its entirety.

TECHNICAL FIELD

Embodiments of the present disclosure relate to the field of display technologies, and in particular to a display panel and a display device.

BACKGROUND

The organic light-emitting display device generally includes a plurality of pixels, and each pixel includes a pixel driving circuit. The simplest pixel circuit adopted in the related art is a 2T1C structure. That is, the pixel circuit includes two transistors and a storage capacitor. One of the transistors is a switching transistor, and the other transistor is a driving transistor that drives an organic light-emitting device in a pixel to emit light. The pixel circuit may further include a control transistor electrically connected to the gate electrode of the driving transistor. The control transistor may write a signal into the gate electrode of the driving transistor prior to a light-emitting phase. The control transistors each has a transfer characteristic curve. The transfer characteristic curve is a curve of the control transistor's gate to source voltage versus the leakage current in the control transistor. When the control transistor is in a bias voltage state for a long time, the transfer characteristic curve thereof will drift.

When the organic light-emitting display device is in different display states, the operating states of the driving transistor are also different. That is, according to the different display states of the display device, the driving transistor would have different gate voltages, resulting in the different bias voltages of the control transistor electrically connected to the gate electrode of the driving transistor, so that based on different display states of the display device, the transfer characteristic curve of the control transistor would have different drift degrees. In the light-emitting stage, the control transistor electrically connected to the gate electrode of the driving transistor have different sizes of leakage currents according to different display states of the display device, resulting in a difference in light-emitting brightness of the organic light-emitting device and hence a non-uniform display problem in the display device.

SUMMARY

In view of this, the present disclosure provides a display panel and a display device. At least one hollowed structure is provided on the continuous gate structure of the control transistor electrically connected to the gate electrode of the driving module, so that a plurality of sub-transistors can be formed in the control transistor. The voltage between the source electrode and the drain electrode of each of the sub-transistors is less than the voltage between the source electrode and the drain electrode of the control transistor, thereby reducing the degree of drift of the transfer characteristic curve of the transistor, reducing the difference of the leakage current for the control transistor corresponding to black picture and white picture of the display device, and improving non-uniform displaying of the display device.

According to one aspect, an embodiment of the present disclosure provides a display panel, including: a substrate and a plurality of pixel circuits on the substrate, each of the plurality of pixel circuits includes: a driving module and an organic light-emitting device, the driving module is configured to provide a driving current to the organic light-emitting device, and the organic light-emitting device is configured to emit light in response to the driving current; a data writing module configured to write a data signal into a control terminal of the driving module; a storage module electrically connected to the control terminal of the driving module, and configured to maintain a voltage on the control terminal of the driving module in an emit-lighting phase; and a plurality of control modules each electrically connected to the control terminal of the driving module, and configured to write a signal to the control terminal of the driving module prior to the light-emitting phase, the plurality of control modules each has a control transistor comprising a continuous active layer structure and a continuous gate structure. The continuous gate structure includes at least one hollowed structure, a perpendicular projection of the hollowed structure on the substrate partly covers a perpendicular projection of the continuous active layer structure on the substrate, and a projected area of the hollowed structure on the substrate is larger than a projected area of the continuous active layer structure at a position corresponding to the hollowed structure on the substrate.

According to another aspect, an embodiment of the present disclosure further provides a display device including the display panel according to the first aspect.

The embodiments of the present disclosure provide a display panel and a display device. at least one hollowed structure is provided on the continuous gate structure of the control transistor electrically connected to the gate electrode of the driving module, and a perpendicular projection of the hollowed structure on the substrate partly covers a perpendicular projection of the continuous active layer structure on the substrate, and a projected area of the hollowed structure on the substrate is larger than a projected area of the continuous active layer structure at a position corresponding to the hollowed structure on the substrate, so that a plurality of sub-transistors are formed in the control transistor by utilizing the hollowed structure on the continuous gate structure. Further, the voltage between the source electrode and the drain electrode of the control transistor is applied to the sub-transistors in the control transistor, and the voltage between the source electrode and the drain electrode of each of the sub-transistors is less than the voltage between the source electrode and the drain electrode of the control transistor, and the degree of drift of the transfer characteristic curve of the transistor is reduced as the voltage between the source electrode and the drain electrode of the transistor is decreased. That is, the degree of drift of the transfer characteristic curve of the control transistor is reduced by employing the sub-transistors in the control transistor so as to reduce the difference of the leakage current when the control transistor is in the different display states of the display device, thereby improving non-uniform displaying of the display device.

BRIEF DESCRIPTION OF THE DRAWINGS

Other features, objects, and advantages of the disclosure will become more apparent upon reading the detailed description of the non-limiting embodiments in conjunction with the following drawings, in which.

DETAILED DESCRIPTION

Figure 1:
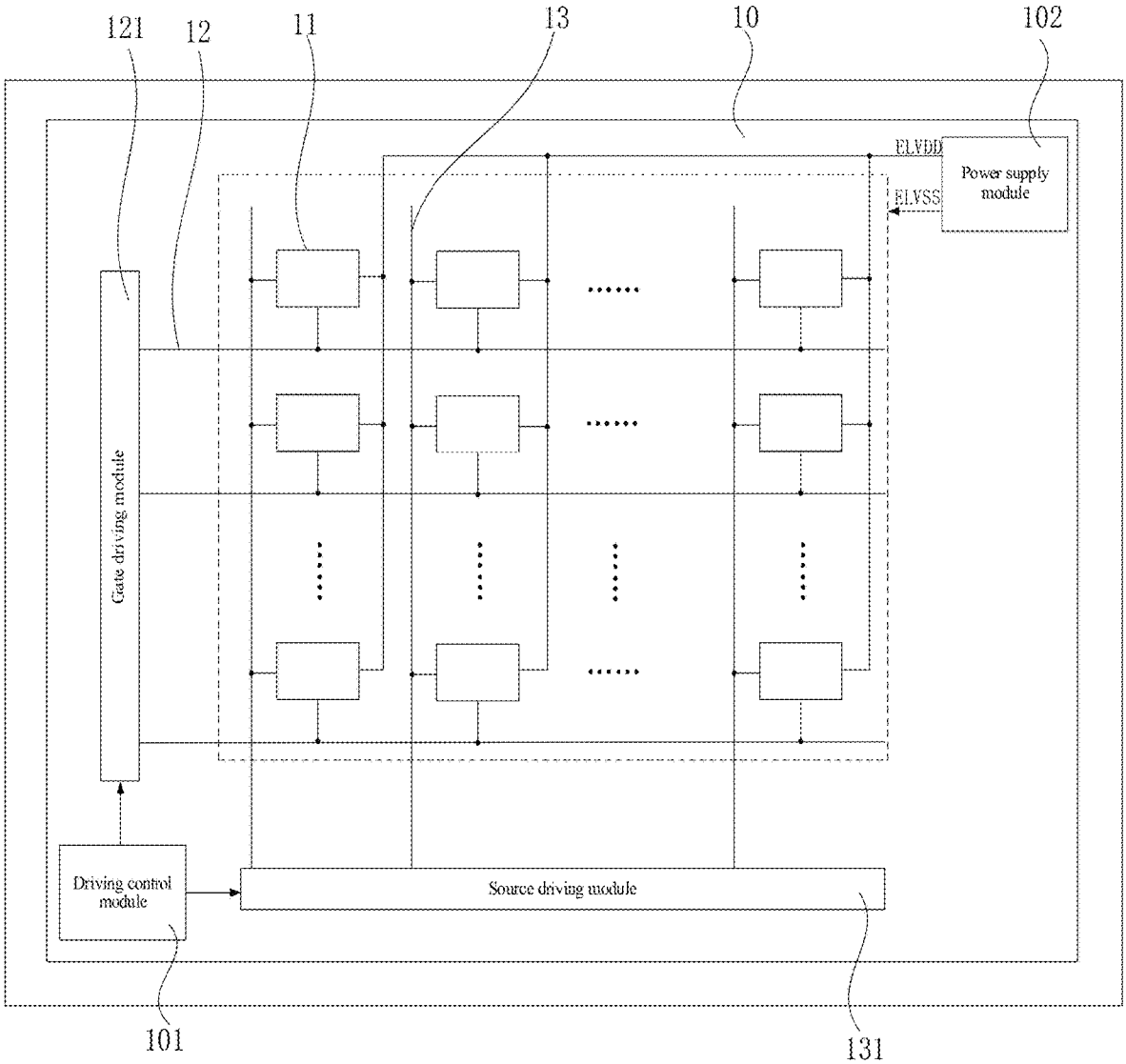
FIG. 1 is a schematic view of a display panel according to an embodiment of the present disclosure.

The present disclosure will be further described in detail below with reference to the accompanying drawings and embodiments. It should be understood that specific embodiments described herein are only used to explain the present disclosure rather than limiting the present disclosure. In addition, it should also be noted that, for the convenience of description, only some but not all structures related to the present disclosure are shown in the accompanying drawings. Throughout the present specification, the same or similar reference numerals denote the same or similar structures, elements or processes. It should be noted that, in the case of no conflict, embodiments in the present application and features in the embodiments may be combined with each other.

An embodiment of the present disclosure provides a display panel including a substrate and a plurality of pixel circuits located on the substrate, each of the plurality of pixel circuits including a driving module, a data writing module, a storage module, and at least one control module. The driving module is configured to provide a driving current to the organic light-emitting device. The organic light-emitting device is configured to emit light in response to the driving current. The data writing module is configured to write a data signal into a control terminal of the driving module. The storage module is electrically connected to the control terminal of the driving module for maintaining a voltage on the control terminal of the driving module in an emit-lighting phase. The control module is electrically connected to the control terminal of the driving module for writing a signal into the control terminal of the driving module prior to the light-emitting stage.

The control module includes a control transistor including a continuous active layer structure and a continuous gate structure; the continuous gate structure includes at least one hollowed structure, a perpendicular projection of the hollowed structure on the substrate partly covers a perpendicular projection of the continuous active layer structure on the substrate, and a projected area of the hollowed structure on the substrate is larger than a projected area of the continuous active layer structure at a position corresponding to the hollowed structure on the substrate.

In each of the plurality of pixel circuits of the organic light-emitting display device, the driving module electrically connected to the control terminal of the driving module may write a signal into the control terminal of the driving transistor prior to a light-emitting phase. The control transistors each correspond to a transfer characteristic curve, that is, the curve of the voltage between the gate electrode and the source electrode of the control transistor versus the leakage current generated by the control transistor. When the control transistor is in a bias voltage state for a long time, the transfer characteristic curve thereof will drift.

When the organic light-emitting display device is in different display states, the operating states of the driving transistor are also different. That is, according to the different display states of the display device, the control terminal of the driving transistor would have different voltages. For example, when the display device is used to display a black picture, the driving module is in a cut-off state. When the display device is used to display a white screen, the driving module is in a conducted state, and the control terminal voltage of the driving module corresponding to the black screen is different from that corresponding to the white screen. When the picture displayed by the display device includes both the black picture and the white picture, the bias voltage of the control transistor electrically connected to the control terminal of the driving module is different, that is, the transfer characteristic curve of the control transistor corresponding to the black picture is different from that corresponding to the white picture, so that the control transistor electrically connected to the gate electrode of the driving transistor during the light-emitting phase has different magnitudes of the leakage current when it corresponds to different display states of the display device, thereby making a difference in the light-emitting brightness of the organic light-emitting device, and hence the display device has a non-uniform display problem.

In the embodiments of the present disclosure, at least one hollowed structure is provided on the continuous gate structure of the control transistor electrically connected to the gate electrode of the driving module, and a perpendicular projection of the hollowed structure on the substrate partly covers a perpendicular projection of the continuous active layer structure on the substrate, and a projected area of the hollowed structure on the substrate is larger than a projected area of the continuous active layer structure at a position corresponding to the hollowed structure on the substrate, so that a plurality of sub-transistors are formed in the control transistor by utilizing the hollowed structure on the continuous gate structure. Further, the voltage between the source electrode and the drain electrode of the control transistor is applied to the sub-transistors in the control transistor, and the voltage between the source electrode and the drain electrode of each of the sub-transistors is less than the voltage between the source electrode and the drain electrode of the control transistor, and the degree of drift of the transfer characteristic curve of the transistor is reduced as the voltage between the source electrode and the drain electrode of the transistor is decreased. That is, the degree of drift of the transfer characteristic curve of the control transistor is reduced by employing the sub-transistors in the control transistor so as to reduce the difference of the leakage current when the control transistor is in the different display states of the display device, thereby improving non-uniform displaying of the display device.

The core idea of the present application is mentioned above. The technical solutions in the embodiments of the present disclosure will be described clearly and completely below with the embodiments of the present disclosure with reference to the accompanying drawings. Apparently, the described embodiments are merely some of the embodiments of the present disclosure rather than all of the embodiments. All other embodiments obtained by those of ordinary skill in the art based on the embodiments of the present disclosure without any creative effort shall fall within the protection scope of the present disclosure.

FIG. 1 is a schematic view of a display panel according to an embodiment of the present disclosure. Referring to FIG. 1, the display panel includes a substrate 10 and a plurality of pixel circuits 11 located on the substrate 10. The display panel further includes a plurality of scan signal lines 12, a plurality of data signal lines 13, a gate driving module 121, a source driving module 131, a driving control module 101 and a power supply module 102. The pixel circuits 11 are disposed in spaces formed by crossing the scan signal lines 12 with the data signal lines 13. Responsive to a scan drive control signal generated by the driving control module 101, the gate driving module 121 inputs a scan signal to the corresponding pixel circuit 11 via the scan signal line 12. The pixel circuit 11 is enabled, based on the scan signal inputted via the scan signal line 12 electrically connected to the pixel circuit 11, to be connected to the corresponding data signal line 13 electrically connected to the pixel circuit 11. Responsive to a data drive control signal generated by the driving control module 101, the source driving module 131 inputs the data signal to the corresponding pixel circuit 11 via the data signal line 13. The power supply module 102 provides the pixel circuit 11 with a first pixel power supply ELVDD and a second pixel power supply ELVSS, thereby achieving the display function of the display panel.

Figure 2:
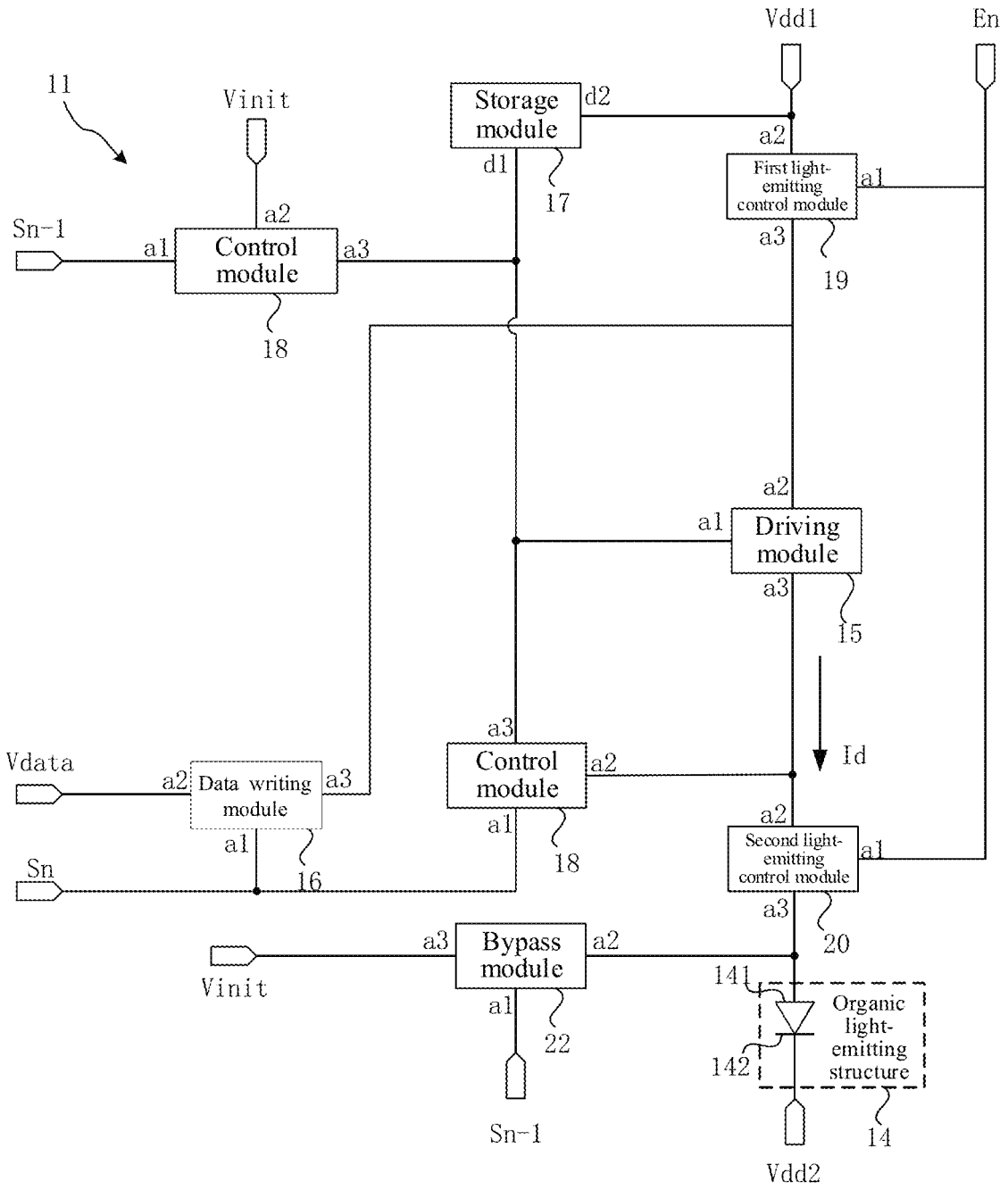
FIG. 2 is a schematic circuit diagram of a pixel circuit according to an embodiment of the present disclosure.

FIG. 2 is a schematic circuit diagram of a pixel circuit according to an embodiment of the present disclosure. As shown in FIG. 2, the pixel circuit 11 includes: a driving module 15, a data writing module 16, a storage module 17 and control module 18. FIG. 2 exemplarily shows that the pixel circuit 11 includes two control modules 18. The driving module 15 provides a driving current Id to an organic light-emitting device 14. The organic light-emitting device 14 emits light in response to the driving current Id. The data writing module 16 may write a data signal into a control terminal a1 of the driving module 15. The storage module 17 is electrically connected to the control terminal a1 of the driving module 15 to maintain the voltage at the control terminal a1 of the driving module 15 in the light-emitting stage.

Figure 3:
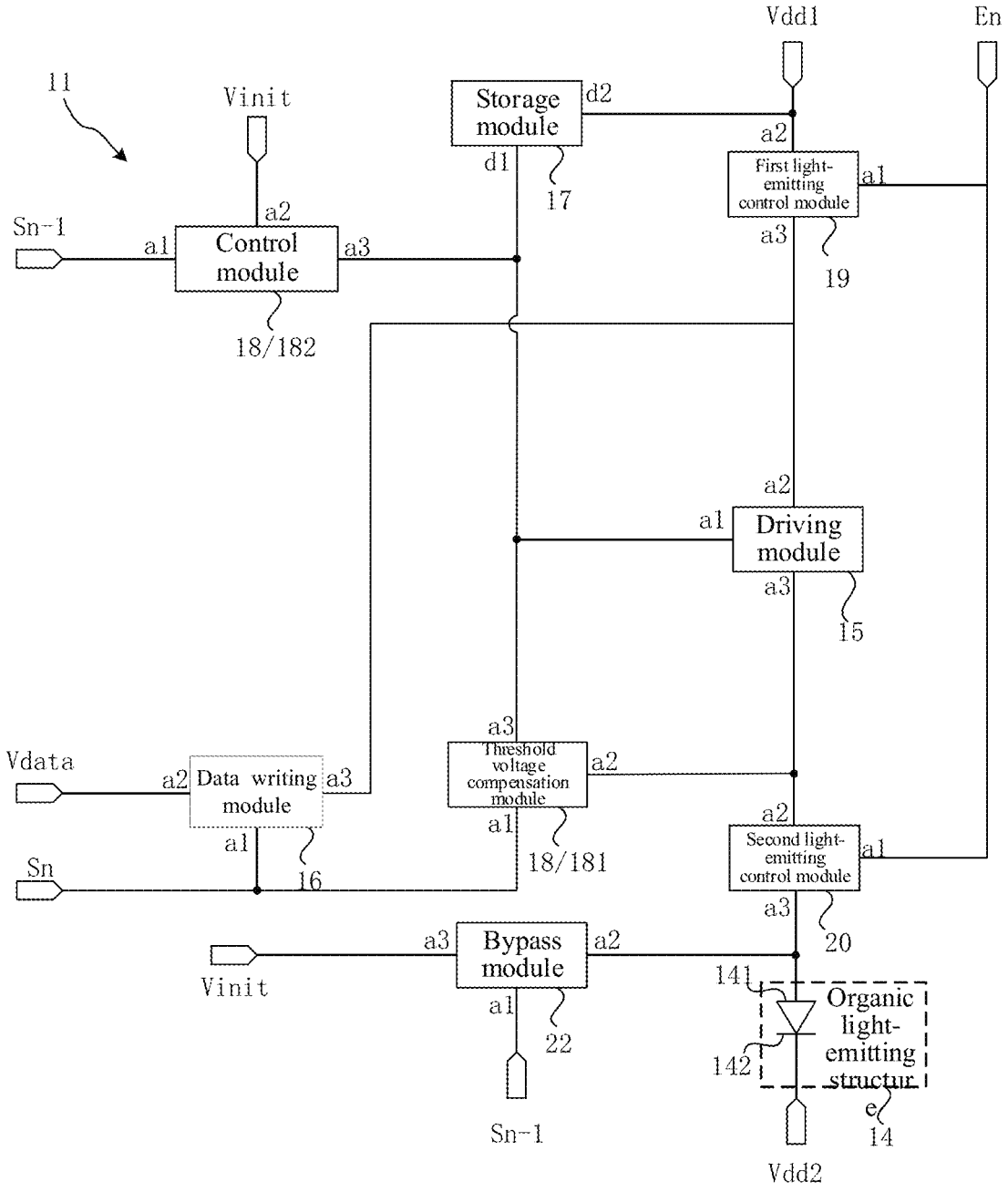
FIG. 3 is a schematic circuit diagram of a pixel circuit corresponding to FIG. 2.

In an embodiment, FIG. 3 is a schematic circuit diagram of a pixel circuit corresponding to FIG. 2. As shown in FIG. 2 in combination with FIG. 3, a control module 18 in the pixel circuit 11 may be a threshold voltage compensation module 181. The pixel circuit 11 may further include a first light-emitting control module 19 and a second light-emitting control module 20.

The control terminal a1 of the data writing module 16 is electrically connected to the first scan signal input terminal Sn, the first terminal a2 thereof is electrically connected to the data signal input terminal Vdata, the second terminal a3 thereof is electrically connected to the first terminal a2 of the driving module 15. The writing module 16 can control the first terminal a2 to be connected to the second terminal a3 thereof according to the scan signal inputted from the first scanning signal input terminal Sn, and transmit the data signal inputted from the data signal input terminal Vdata to the control terminal a1 of the driving module 15.

The driving module 15 may receive the data signal inputted from the data signal input terminal Vdata according to the connected state of the data writing module 16 to provide the driving current Id to the organic light-emitting device 14.

The control terminal a1 of the threshold voltage compensation module 181 is electrically connected to the first scan signal input terminal Sn, the first terminal a2 thereof is electrically connected to the second terminal a3 of the driving module, the second terminal a3 thereof is electrically connected to the control terminal a1 of the driving module 15. The threshold voltage compensation module 181 may control the first terminal a2 to be connected with the second terminal a3 according to the scan signal inputted from the first scan signal input terminal Sn so as to electrically connect the control terminal a1 and the second terminal a3 of the driving module 15. That is, the first terminal a2 and the second terminal a3 of the compensation module 181 are connected so that the driving module 15 forms a diode-like connection structure.

The control terminal a1 of the first light-emitting control module 19 is electrically connected to the enable signal input terminal En, the first terminal a2 thereof is electrically connected to the first power signal input terminal Vdd1, and the second terminal a3 thereof is electrically connected to the first terminal a2 of the driving module 15. The control terminal a1 of the second light-emitting control module 20 is electrically connected to the enable signal input terminal En, the first terminal a2 thereof is electrically connected to the second terminal a3 of the driving module 15, the second terminal a3 thereof is electrically connected to the first electrode 141 of the organic light-emitting device 14. The first light-emitting control module 19 and the second light-emitting control module 20 can control the respective first terminals a2 and the second terminals a3 to be connected with each other, respectively, based on the enable signal inputted from the enable signal input terminal En, so that the power signal is inputted from the first power signal input terminal Vdd1 is transmitted to the first electrode 141 of the organic light-emitting device 14 through the diode-connected driving module 15 and the second light-emitting control module 20.

The second electrode 142 of the organic light-emitting device 14 is electrically connected to the second power signal input terminal Vdd2. The first terminal d1 of the storage module 17 is electrically connected to the control terminal a1 of the driving module 15, and the second terminal d2 thereof is electrically connected to the first power signal input terminal Vdd1.

In an embodiment, with reference to FIG. 2 and FIG. 3, a control module 18 may be an initialization module 182. A control terminal a1 of the initialization module 182 is electrically connected to a second scan signal input terminal Sn−1, the first terminal a2 thereof is electrically connected to a reference voltage signal input terminal Vinit, and the second terminal a3 is electrically connected to the control terminal of the driving module 15. The initialization module 182 can control the first terminal a2 to be connected to the second terminal a3 based on the scan signal inputted from the second scan signal input terminal Sn−1, so that the reference voltage signal inputted from the reference voltage signal input terminal Vinit is transmitted to the control terminal a1 of the driving module 15 to realize the initializing operation of the potential at the control terminal a1 of the driving module 15.

In an embodiment, as shown in FIG. 2, the pixel circuit 11 in the display panel may further include a bypass module 22. The control terminal a1 of the bypass module 22 is electrically connected to the second scan signal input terminal Sn−1, the first terminal a2 thereof is electrically connected to the first electrode 141 of the organic light-emitting device 14, and the second terminal a3 thereof is electrically connected to the reference voltage signal input terminal Vinit.

Figure 4:
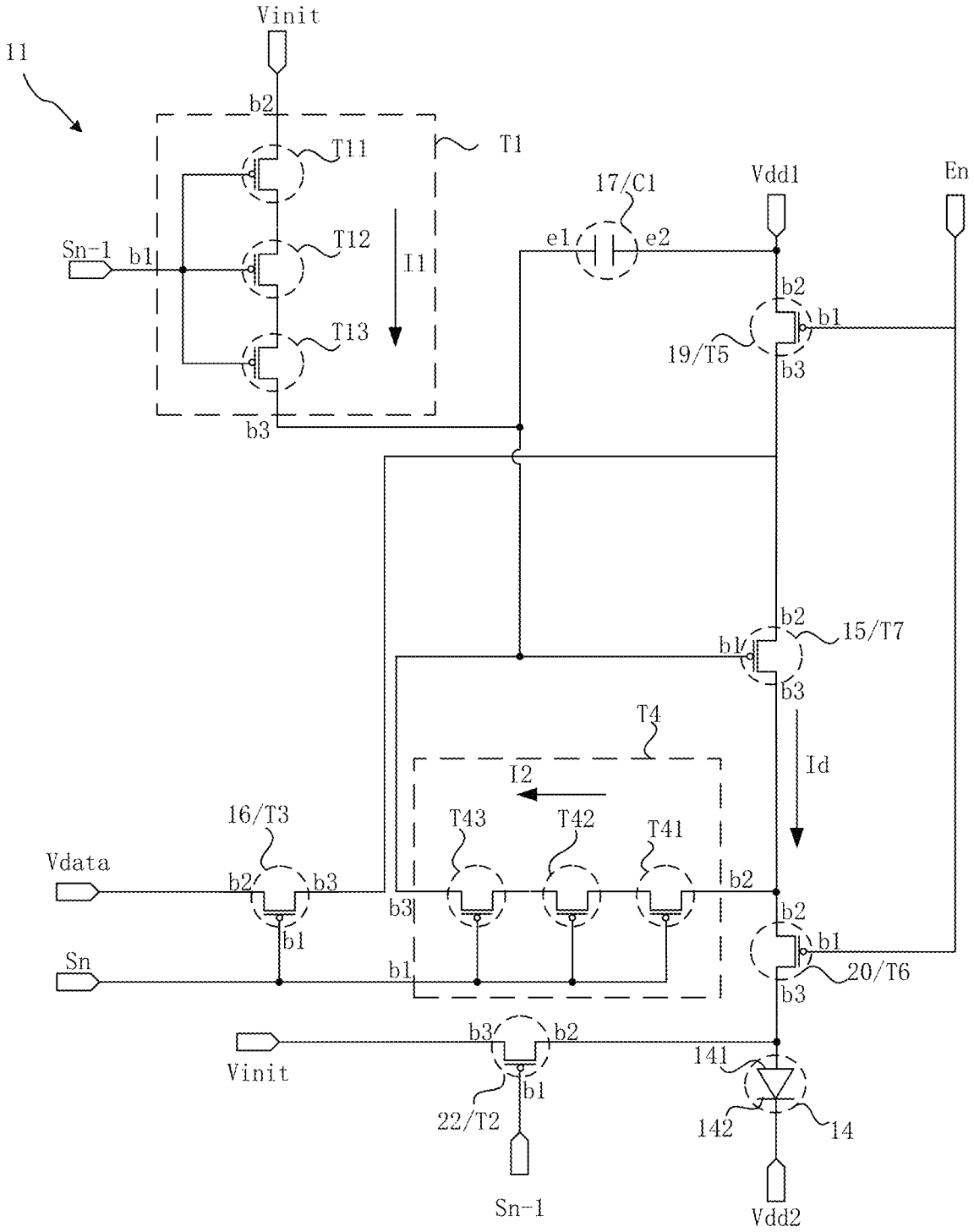
FIG. 4 is a schematic circuit diagram of a specific circuit corresponding to the pixel circuit shown in FIG. 3.

FIG. 4 is a schematic diagram of the specific circuit structure corresponding to the pixel circuit shown in FIG. 3. As shown in FIGS. 3 and 4, a control transistor may be an initialization transistor T1, a bypass module 22 may include a bypass transistor T2, a data writing module 16 may include a data writing transistor T3, and a control transistor may be a threshold voltage compensation transistor T4. The first light-emitting control module 19 may include the first light-emitting control transistor T5, the second light-emitting control module 20 may include the second light-emitting control transistor T6, the driving module 15 may include the driving transistor T7, and the storage module 17 may include the storage capacitor C1.

The gate electrode b1 of the initialization transistor T1 is electrically connected to the second scan signal input terminal Sn−1, the first electrode b2 thereof is electrically connected to the reference voltage signal input terminal Vinit, and the second electrode b3 thereof is electrically connected to the gate electrode b1 of the driving transistor T7. The gate electrode b1 of the pass transistor T2 is electrically connected to the second scan signal input terminal Sn−1, the first electrode b2 thereof is electrically connected to the first electrode 141 of the organic light-emitting device 14, and the second electrode b3 thereof is electrically connected to the reference voltage signal input terminal Vinit. The gate electrode b1 of the data writing transistor T3 is electrically connected to the first scan signal input terminal Sn, the first electrode b2 thereof is electrically connected to the data signal input terminal Vdata, and the second electrode b3 thereof is electrically connected to the first electrode b2 of the driving transistor T7. The gate electrode b1 of the threshold voltage compensation transistor T4 is electrically connected to the first scan signal input terminal Sn, the first electrode b2 thereof is electrically connected to the second electrode b3 of the driving transistor T7, and the second electrode b3 thereof is electrically connected to the gate electrode b1 of the driving transistor T7. The gate electrode b1 of the first light-emitting control transistor T5 is electrically connected to the enable signal input terminal En, the first electrode b2 thereof is electrically connected to the first power signal input terminal Vdd1, the second electrode b3 thereof is electrically connected to the first electrode b2 of the first driving transistor T71. The gate electrode b1 of the second light-emitting control transistor T6 is electrically connected to the enable signal input terminal En, the first electrode b2 thereof is electrically connected to the second electrode b3 of the driving transistor T7, and the second electrode b3 thereof is electrically connected to the first electrode 141 of the organic light-emitting device 14. The first electrode e1 of the storage capacitor C1 is electrically connected to the gate electrode b1 of the driving transistor T7 and the second electrode e2 thereof is electrically connected to the first power signal input terminal Vdd1.

Figure 5:
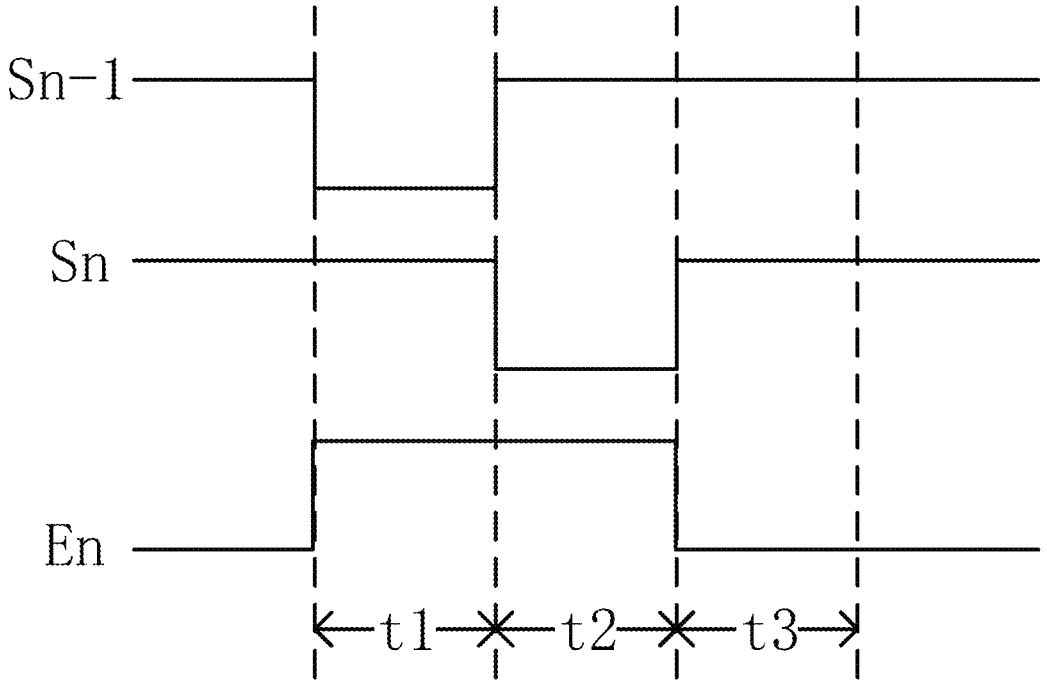
FIG. 5 is a driving timing diagram of a pixel circuit according to an embodiment of the present disclosure.

FIG. 5 is a driving timing diagram of a pixel circuit according to an embodiment of the present disclosure. Exemplarily, the initialization transistor T1, the bypass transistor T2, the data writing transistor T3, the threshold voltage compensation transistor T4, the first light-emitting control transistor T5, the second light-emitting control transistor T6 and the driving transistor T7 may be arranged as a P-type transistor as shown in FIG. 4, and also the initialization transistor, the data writing transistor, the threshold voltage compensation transistor, the driving transistor, the first light-emitting control transistor, the second light-emitting control transistor and the bypass transistor are all N-type transistors, which is not limited in the embodiments of the present disclosure. The working principle of the pixel circuit 11 in the display panel will be described below with reference to FIGS. 3, 4 and 5.

During a time period t1 (the initialization phase), the first electrode b2 and the second electrode b3 of each of the initializing transistor T1 and the bypass transistor T2 are connected to each other based on the low level inputted from the second scan signal input terminal Sn−1. the first electrode b2 and the second electrode b3 of each of the threshold voltage compensation transistor T4, the first light-emitting control transistor T5, the second light-emitting control transistor T6 and the driving transistor T7 are disconnected to each other based on the control signal inputted to the gate electrode b1 thereof.

In this case, the reference voltage signal inputted from the reference voltage signal input terminal Vinit is transmitted to the gate electrode b1 of the driving transistor T7 through the initialization transistor T1, and the driving transistor T7 is initialized with the reference voltage signal. Similarly, the reference voltage signal inputted from the reference voltage signal input terminal Vinit is transmitted to the first electrode 141 of the organic light-emitting device 14 through the bypass transistor T2, and the organic light-emitting device 14 is initialized by the reference voltage signal.

During a time period t2 (the data write phase), the first electrode b2 and the second electrode b3 of each of the initializing transistor T1 and the bypass transistor T2 are disconnected to each other based on the high level inputted from the second scan signal input terminal Sn−1. The first electrode b2 and the second electrode b3 of each of the data writing transistor T3 and the threshold voltage compensation transistor T4 are connected to each other based on the low level inputted from the first scan signal input terminal Sn.

In this case, based on the threshold voltage compensation transistor T4, the driving transistor T7 is equivalent to a diode and forward-biased, and the compensation voltage obtained by subtracting the threshold voltage of the driving transistor T7 from the voltage of the data signal inputted from the data signal input terminal Vdata electrically connected to the first electrode b2 of the data writing transistor T3 is applied to the gate electrode b1 of the driving transistor T7. At this time, the voltage on the first electrode e1 of the storage capacitor C1 is equal to the compensation voltage, the voltage on the second electrode e2 of the storage capacitor C1 is equal to the voltage value Vdd of the power signal inputted from the first power signal input terminal Vdd1, and the charge corresponding to the voltage difference between the first electrode e1 and the second electrode e2 of the storage capacitor C1 is stored in the storage capacitor C1.

During a time period t3 (the light-emitting phase), the first electrode b2 and the second electrode b3 of each of the initializing transistor T1 and the bypass transistor T2 is disconnected to each other based on the high level inputted from the second scan signal input terminal Sn−1. the first electrode b2 and the second electrode b3 of each of the data writing transistor T3 and the threshold voltage compensation transistor T4 are disconnected to each other based on the high level inputted from the first scan signal input terminal Sn. the first electrode b2 and the second electrode b3 of each of the control transistor T5 and the second light-emitting control transistor T6 is connected to each other based on the low level inputted from the enable signal input terminal En.

In this case, the power signal inputted from the first power signal input terminal Vdd1 is transmitted to the first electrode b2 of the driving transistor T7 through the first light-emitting control transistor T5. The driving current Id generated by the voltage difference between the voltage of the gate electrode b1 of the driving transistor T7 and the voltage Vdd of the power signal inputted from the first power signal input terminal Vdd1 flows to the organic light-emitting device 14 through the second light-emitting control transistor T6. The organic light-emitting device 14 emits light in response to the driving current Id.

During the period t3, the voltage Vgs between the gate electrode b1 and the source electrode (first electrode b2) of the driving transistor T7 is held or substantially maintained (Vdata+Vth)−Vdd by the storage capacitor C1, and according to the correspondence relationship between the driving current Id of the driving transistor T7 and the voltage difference between the gate electrode b1 and the source electrode (first electrode b2), the driving current Id of the driving transistor T7 is proportional to the square of "the voltage Vgs between the gate electrode b1 and the source electrode (first electrode b2) minus the threshold voltage Vth of the driving transistor" (i.e., $(Vdata-Vdd)^2$). Therefore, the driving current Id of the driving transistor T7 is independent of the threshold voltage Vth of the driving transistor T7. Therefore, the storage module 17 of the storage capacitor C1 captures the threshold voltage of the driving transistor T7 and compensates for the threshold voltage of the driving transistor T7 so that the driving current flowing through the organic light-emitting device 14 at the time period t3 (light-emitting phase) is independent of the threshold voltage of the driving transistor T7.

In addition, during the time period t3, the first electrode b2 and the second electrode b3 of the bypass transistor T2 is disconnected based on the high level inputted from the second scan signal input terminal Sn−1, A part of the driving current Id transmitted from the second light-emitting control transistor T6 flows through the bypass transistor T2 as a bypass current. When the display device is intended to display a black picture, even though the driving transistor T7 is in the cut-off state, the minimum current generated therefrom and flowing through the organic light-emitting device 14 cannot ensure that the display device correctly displays the black picture. The arrangement of the bypass transistor T2 enables a part of the minimum current generated by the driving transistor T7 to be distributed as a bypass current to the current path other than the current path where the organic light-emitting device 14 is located, so that the display device can display a black picture more accurately to improve the contrast of the display device.

It should be noted that, the high level and the low level mentioned in the foregoing embodiments are relative concepts. The embodiment of the present disclosure does not limit the value of the specific level included in the high level and the low level. In addition, the number of transistors and the number of capacitors in the pixel circuit are not limited in the embodiment of the present disclosure, and the number of transistors and the number of capacitors in the pixel circuit can be specifically set according to actual production requirements.

Figure 6:
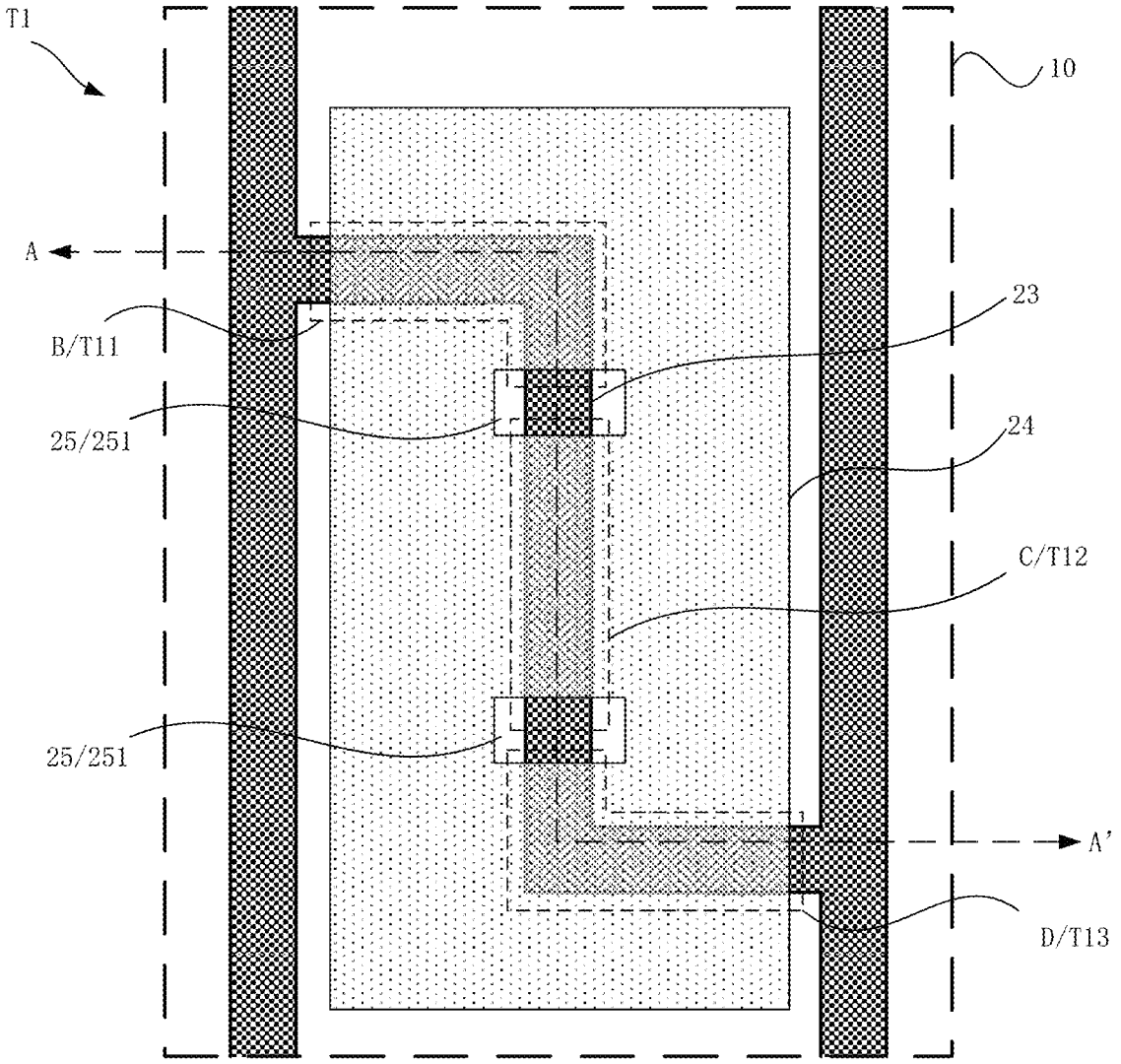
FIG. 6 is a schematic top view of a control transistor according to an embodiment of the present disclosure.

FIG. 6 is a schematic top view of a control transistor according to an embodiment of the present disclosure. As shown in FIG. 6, for example, the control transistor is the initialization transistor T1, the control transistor (initialization transistor T1) includes a continuous active layer structure 23 and a continuous gate structure 24. The continuous gate structure 24 includes at least one hollowed structure 25. A perpendicular projection of the hollowed structure 25 on the substrate 10 partly covers a perpendicular projection of the continuous active layer 23 structure on the substrate 10, and a projected area of the hollowed structure 25 on the substrate 10 is larger than a projected area of the continuous active layer structure 23 at a position corresponding to the hollowed structure 25 on the substrate 10.

In an embodiment, as shown in FIG. 6, the hollowed structure 25 may be a through-hole structure 251. It is exemplarily arranged that the continuous gate structure 24 includes two hollowed structures 25, that is, two through-hole structures 251, and the perpendicular projection of the through-hole structure 251 on the substrate 10 is set to cover the perpendicular projection of the continuous active layer 23 on the substrate 10 at a position corresponding to the through-hole structure 251. The projected area of the through-hole structure 251 on the substrate 10 is set be greater than the projected area of the continuous active layer structure 23 at a position corresponding to the through-hole structure 251 on the substrate 10, such that, there are three overlapping portions B, C, and D of the continuous gate structure 24 with the continuous active layer structure 23.

The hollowed structure 25 is disposed so as to form a plurality of sub-transistors in the control transistor without changing the structure of the original film of the control transistor. Referring to FIGS. 6 and 4, taking the control transistor as the initialization transistor T1 as an example, the overlap portion B forms the first sub-transistor T11 in the initialization transistor T1. The overlap portion C forms the second sub-transistor T12 in the initialization transistor T1. The overlapping portion D forms a third sub-transistor T13 in the initialization transistor T1. Therefore, the hollowed structure 25 is disposed such that the voltage between the source electrode and the drain electrode of the control transistor is applied to the sub-transistors T11, T12 and T13 in the control transistor, and the voltage between the source electrode and the drain electrode of each sub-transistor is less than the voltage between the source electrode and the drain electrode of the control transistor, and the degree of drift of the transfer characteristic curve of the transistor is reduced as the voltage between the source electrode and the drain electrode of the transistor is decreased. The degree of drift of the transfer characteristic curve of the control transistor is reduced by employing the sub-transistors in the control transistor so as to reduce the difference of the leakage current when the control transistor is in the different display states of the display device, thereby improving non-uniformity of the display device in displaying.

Figure 7:
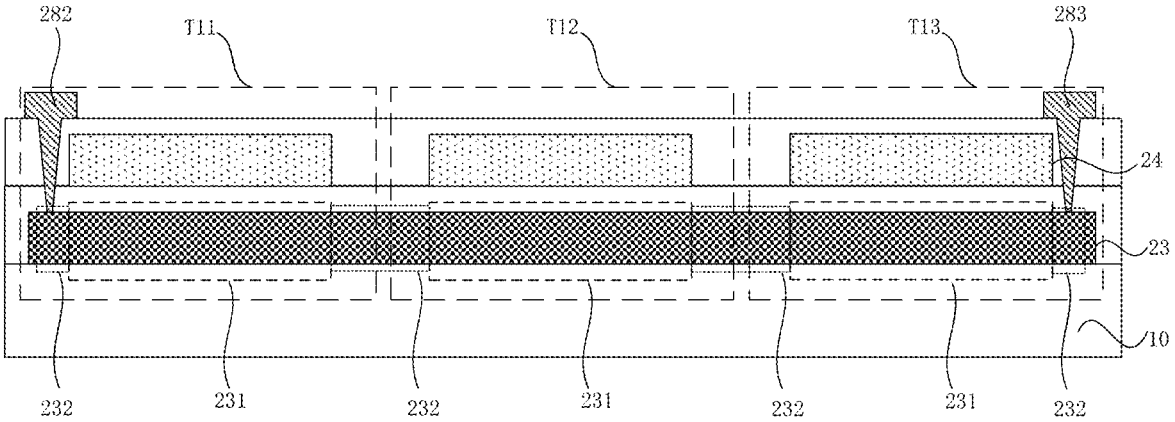
FIG. 7 is a schematic cross-sectional structure along A-A' in FIG. 6.

FIG. 7 is a schematic cross-sectional structure taken along A-A' in FIG. 6. The continuous active layer structure 23 may include a channel 231 doped with N-type impurities or P-type impurities and a doping unit 232 formed at both sides of the channel 231 and doped with more N-type impurities or P-type impurities. The continuous active layer structure 23 of the control transistor may be made of polysilicon or amorphous silicon material. The doping unit 232 in the continuous active layer structure 23 may be formed by doping N-type impurities or P-type impurities into the polysilicon or amorphous silicon material.

Referring to FIGS. 6 and 7, the doping unit 232 on left side of the leftmost channel 231 as shown in FIG. 7 is electrically connected to the source structure 282 of the initialization transistor T1 made of a metal material. The doping unit 232 on the right side of the rightmost channel 231 is electrically connected to the drain structure 283 of the initialization transistor T1 made of a metal material. The continuous gate structure 24 of the initialization transistor T1 may also be made of a metal material. The doping unit 232 prior to the adjacent sub-transistors 232 realizes the electrical connections between the first sub-transistor T11 and the second sub-transistor T12 and between the second sub-transistor T12 and the third sub-transistor T13 in the initialization transistor T1.

Figure 8:
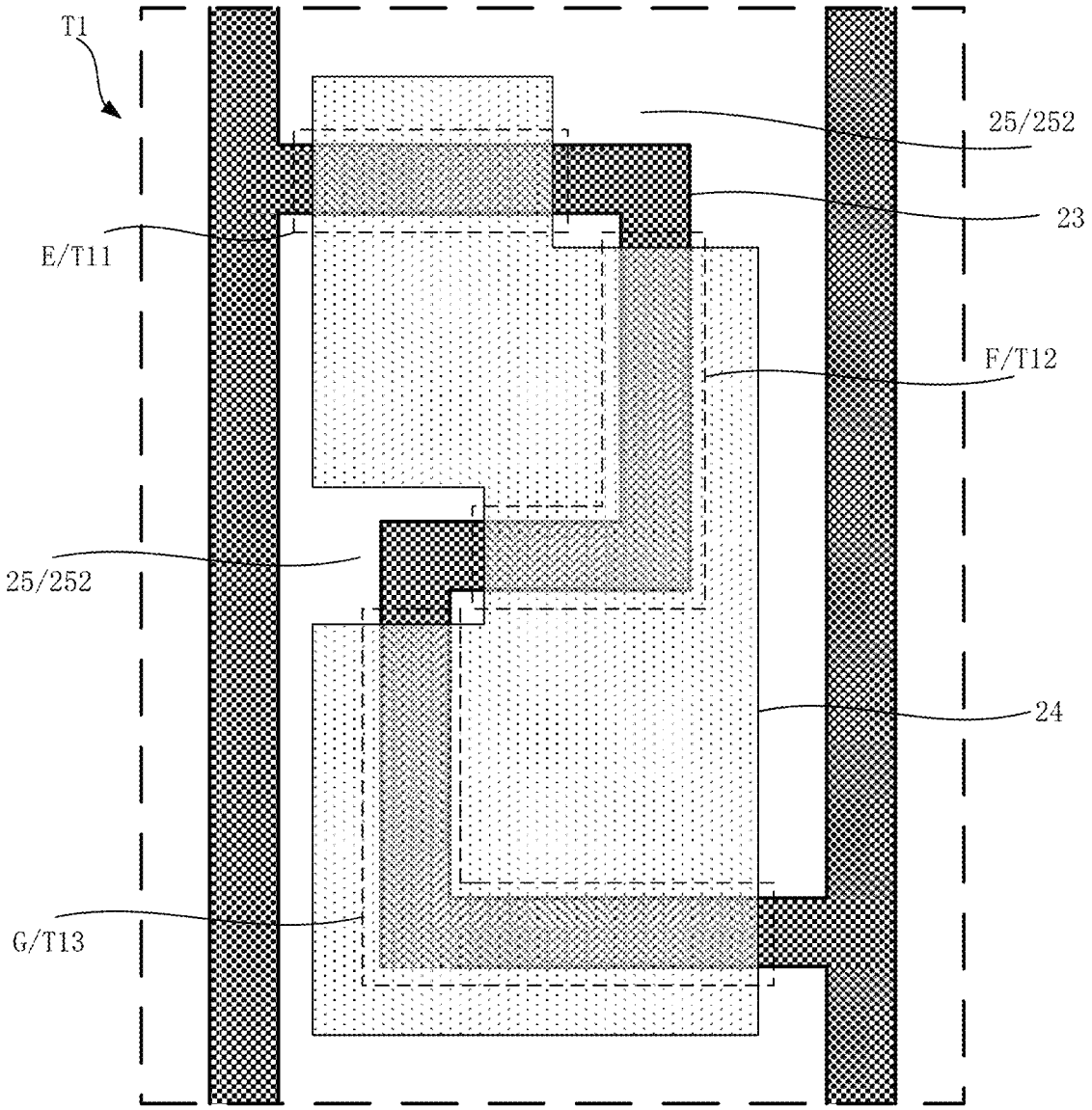
FIG. 8 is a schematic top view of another control transistor according to an embodiment of the present disclosure.

In an embodiment, the hollowed structure 25 may also be a groove structure 252 as shown in FIG. 8. It is exemplarily arranged that the continuous gate structure 24 includes two hollowed structures 25, that is, two groove structures 252. The perpendicular projection of the groove structure 252 on the substrate 10 covers the perpendicular projection of the continuous active layer structure 23 at a position corresponding to the groove structure 252 on the substrate 10, and the projected area of the groove structure 252 on the substrate 10 is greater than the projected area of the continuous active layer structure 23 at the position corresponding to the recess structure 252 on the substrate, such that there are three overlapping portions E, F, and G of the continuous gate structure 24 with the continuous active layer structure 23.

Referring to FIGS. 8 and 4, taking the control transistor as the initialization transistor T1 as an example, the overlapping portion E forms the first sub transistor T11 in the initialization transistor T1, the overlapping portion F forms the second sub transistor T12 in the initialization transistor T1, and the overlapping portion G forms the third sub-transistor T13 in the initialization transistor T1. Similarly, the arrangement of the hollowed structure 25 enables to form a plurality of sub-transistors in the control transistor. By using the sub-transistors in the control transistor, the drift of the transfer characteristic curve of the control transistor can be reduced, thereby reducing the leakage current of the control transistor in different display states of the display device, and hence improving non-uniform displaying of the display device.

Figure 9:
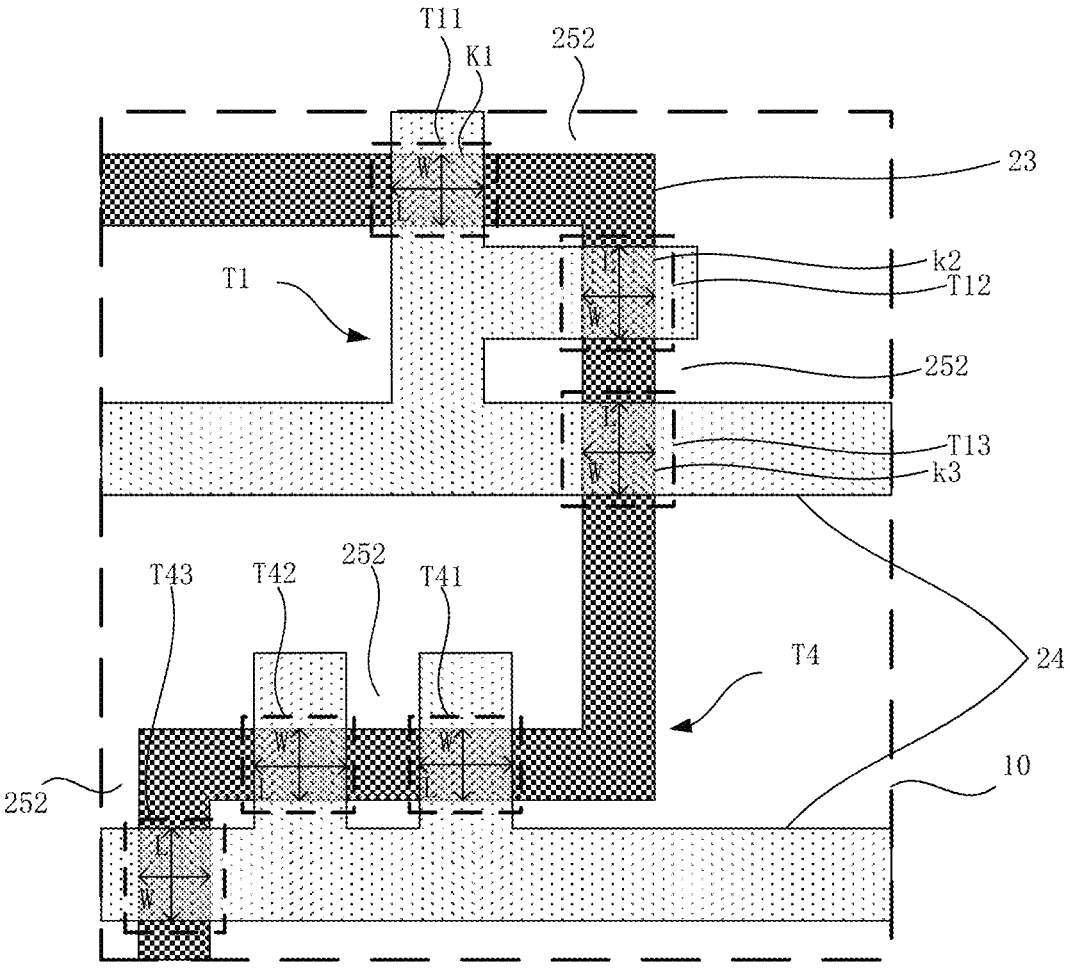
FIG. 9 is a schematic top view of another control transistor according to an embodiment of the present disclosure.

FIG. 9 is a schematic top view of another control transistor according to an embodiment of the present disclosure. As shown in FIG. 9, similar to the structure of the control transistor shown in FIG. 8, the continuous gate structure 24 of each control transistor (taking the control transistor as the initialization transistor T1 for example) is also provided with two groove structures 252. The control transistor includes a plurality of sub-transistors on the basis that the original film structure of the control transistor is not changed. The difference lies in the shape of the continuous gate structure 23 and the continuous active layer structure 24 of the control transistor compared with those shown in FIG. 8. The shape of the continuous gate structure 23 and the continuous active layer structure 24 in the control transistor is not limited in the embodiments of the present disclosure.

Figure 10:
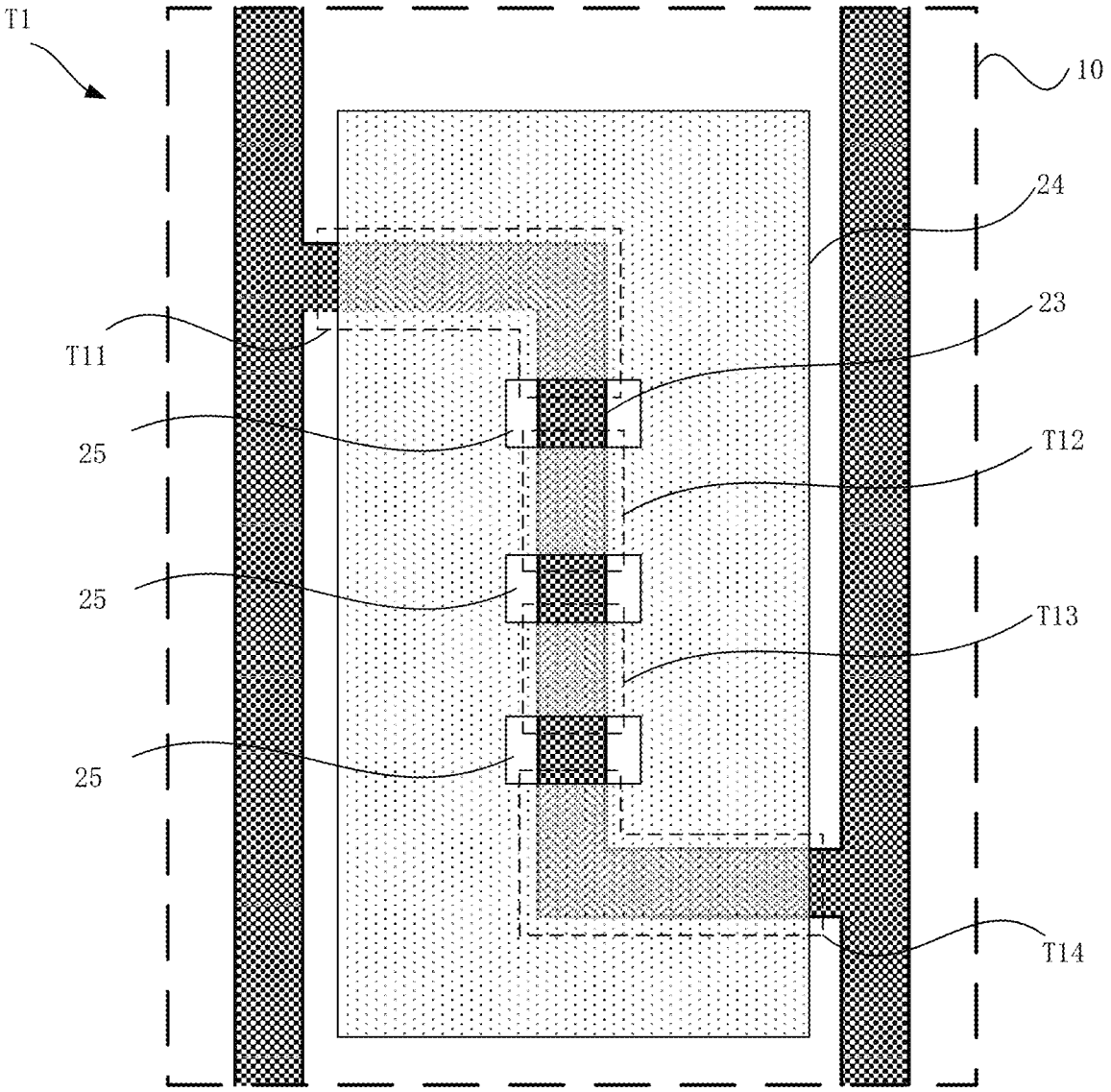
FIG. 10 is a schematic top view of another control transistor according to an embodiment of the present disclosure.

In an embodiment, the control transistor may also be configured as shown in FIG. 10. A control transistor is the initialization transistor T1, for example, and the control transistor forms four sub-transistors T11 T12, T13 and T14 by providing three hollowed structures 25 on the continuous gate structure. The number of the hollowed structures 25 in the control transistor is not limited in the embodiments of the present disclosure.

In an embodiment, it is exemplarily provided that control transistors each include three sub-transistors, that is, as shown in FIG. 4, the initialization transistor T1 includes three sub-transistors T11, T12 and T13, and the threshold voltage compensation transistor T4 includes three sub-transistors T41, T42 and T43, which can be implemented by providing two hollowed structures contained in continuous gate structures of different control transistors. In an embodiment, the number of hollowed structures of different control transistors may also be different, that is, the number of the sub-transistors included in different control transistors may be different, and the number of the hollowed structures in the control transistor is not limited in the embodiment of the present disclosure.

In an embodiment, along a direction perpendicular to the substrate, the continuous active layer structure includes overlapping portions with the continuous gate structure, and a width-to-length ratio of a channel of at least one of the overlapping portions is different from that of other overlapping structures. Referring to FIGS. 4, 7 and 9, taking the control transistor as the initialization transistor T1 as an example, the continuous active layer structure 23 includes the overlapping portions K1, K2, and K3 with the continuous gate structure 24 along the direction perpendicular to the substrate 10. The overlapping portion K1 is the channel 231 of the first transistor T11 in the initializing transistor T1, the overlapping portion K2 is the channel 231 of the second transistor T12 in the initializing transistor T1, and the overlapping portion K3 is the channel 231 of the three sub-transistors T13 in the initializing transistor T1. The length of the channel 231 in the extending direction of the continuous active layer structure 23 is the length L of the channel 231, the width of the channel 231 in the perpendicular direction of the extending direction of the continuous active layer structure 23 is the width W of the channel 231. In an embodiment, in the direction of the leakage current of the control transistor, the width-to-length ratios of the channels corresponding to different overlapping portions may be sequentially decreased or increased. That is, in the direction of the leakage current I1 of the initialization transistor T1, the width-to-length ratios of the channels corresponding to the different overlapping portions can be sequentially decreased or increased.

Exemplarily, it may be set that the width-to-length ratio $$\frac{W}{L}$$

of the channel of the first sub-transistor T11 is greater than the width-to-length ratio $$\frac{W}{L}$$

of the channel of the second sub-transistor T12, and the width-to-length ratio $$\frac{W}{L}$$

of the channel of the second sub-transistor T12 is greater than the width-to-length ratio $$\frac{W}{L}$$

of the channel of the third sub-transistor T13. Alternatively, it may be set that the width-to-length ratio $$\frac{W}{L}$$

of the channel of the first sub-transistor T11 is smaller than the width-to-length ratio $$\frac{W}{L}$$

of the channel of the second sub-transistor T12, and the width-to-length ratio $$\frac{W}{L}$$

of the channel of the second sub-transistor T12 is smaller than the width-to-length ratio $$\frac{W}{L}$$

of the channel of the third sub-transistor T13. Exemplarily, the ratio of the width-to-length ratios of channels of the three sub-transistors can be set to be equal to 3:2:1. For example, the width-to-length ratio of the channel of the first sub-transistor T11 can be set to be equal to three times the width-to-length ratio of the channel of the third sub-transistor T13, and the width-to-length ratio of the channel of the second sub-transistor T12 is equal to two times the width-length ratio of the third sub-transistor T13.

If the width-to-length ratios $$\frac{W}{L}$$

of the three sub-transistors are set to be the same, the voltage between the source electrode and the drain electrode of each sub-transistor is reduced to one-third of the voltage between the source electrode and the drain electrode of the control transistor in the related art. If the ratio of the width-to-length ratios $$\frac{W}{L}$$

of the channels of the three sub-transistors is set to be equal to 3:2:1, the voltage between the source electrode and the drain electrode of the third sub-transistor T13 is reduced to one-sixth of the voltage between the source electrode and the drain electrode of the control transistor in the related art, which is similar to the principle of minimum flow. In this way, the width-to-length ratios $$\frac{W}{L}$$

of the channels of the three sub-transistors set to be different can minimize the difference between the source electrode and the drain electrode of the sub-transistor in the control transistor, so that the drift of the transfer characteristic curve of the control transistor may further be reduced by using the sub-transistors in the control transistor, so as to reduce the difference of the leakage current when the control transistor corresponds to the black picture and the white picture and hence improve non-uniform displaying of the display device.

Exemplarily, as shown in FIG. 4 and FIG. 9, the control transistor may also be the threshold voltage compensation transistor T4. Similarly, the width-to-length ratios of the channels corresponding to the three sub-transistors T41, T42 and T43 in the threshold voltage compensation transistor T4 may also be different from each other. Along the direction of the leakage current I2 of the threshold voltage compensation transistor T4, width-to-length ratios of the channels of the three sub-transistors T41, T42 and T43 are sequentially decreased or increased. The principle and beneficial effects are not described herein again.

In an embodiment, the width of the channel corresponding to the overlapping portion may be greater than or equal to 2 μm and less than or equal to 10 μm, and the length of the channel corresponding to the overlapping portion may be greater than or equal to 1.5 μm and less than or equal to 10 μm. Due to the manufacturing process of the transistor and the requirement of the spatial layout of the display device, the width and the length of the channel corresponding to the overlapping portion cannot be too large or too small.

It should be noted that, the drawings shown in the embodiments of the present disclosure merely illustrate the size of each element and each film layer exemplarily, and do not represent the actual size of each element and each film layer in the display panel.

In the embodiments of the disclosure, at least one hollowed structure is provided on the continuous gate structure of the control transistor electrically connected to the gate electrode of the driving module, and a perpendicular projection of the hollowed structure on the substrate partly covers a perpendicular projection of the continuous active layer structure on the substrate, and a projected area of the hollowed structure on the substrate is larger than a projected area of the continuous active layer structure at a position corresponding to the hollowed structure on the substrate, so that a plurality of sub-transistors are formed in the control transistor by utilizing the hollowed structure on the continuous gate structure. Further, the voltage between the source electrode and the drain electrode of the control transistor is applied to the sub-transistors in the control transistor, and the voltage between the source electrode and the drain electrode of each of the sub-transistors is less than the voltage between the source electrode and the drain electrode of the control transistor, and the drift of the transfer characteristic curve of the transistor is reduced as the voltage between the source electrode and the drain electrode of the transistor is decreased. That is, the drift of the transfer characteristic curve of the control transistor is reduced by employing the sub-transistors in the control transistor so as to reduce the difference of the leakage current when the control transistor is in the different display states of the display device, thereby improving non-uniform displaying of the display device.

Figure 11:
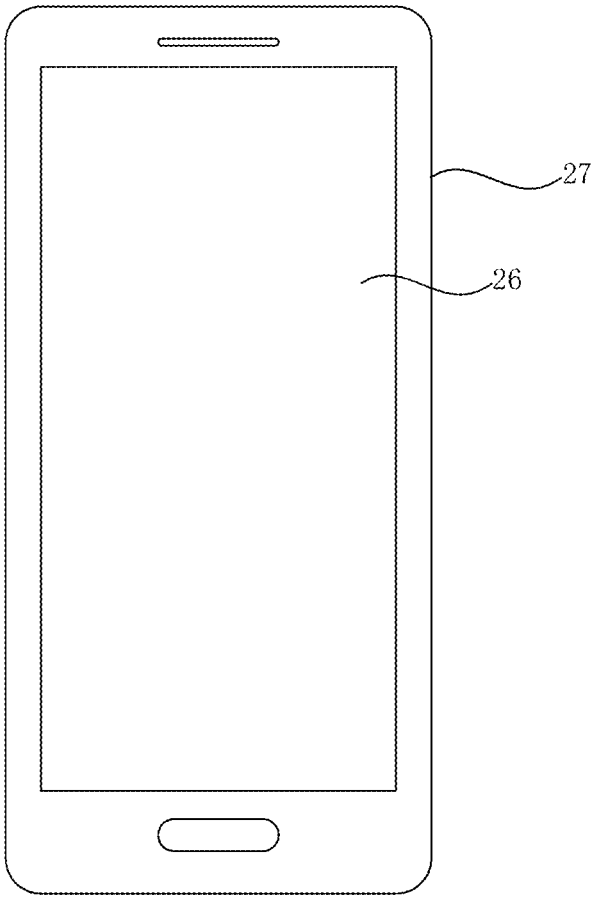
FIG. 11 is a schematic structural diagram of a display device according to an embodiment of the present disclosure.

An embodiment of the present disclosure further provides a display device. FIG. 11 is a schematic structural diagram of a display device according to an embodiment of the present disclosure. As shown in FIG. 11, the display device 27 includes the display panel 26 in above embodiments.

Therefore, the display device 27 provided in this embodiment of the present disclosure also has the advantages described in the foregoing embodiments, and details are not described herein again. Exemplarily, the display device 27 may be an electronic display device such as a mobile phone, a computer or a television.

It should be noted that the above contents are only preferred embodiments of the present disclosure and its technical principles. It can be understood for those skilled in the art that the present disclosure is not limited to specific embodiments described herein. For those skilled in the art, the present disclosure may be subject to various apparent variations, readjustments and replacements without departing from a protection scope of the present disclosure. Therefore, although the present disclosure is described in detail through above embodiments, the present disclosure is not only limited to above embodiments. The present disclosure can also include more other equivalent embodiments without deviating from conceptions of the present disclosure. A scope of the present disclosure is determined by a scope of attached claims.

What is claimed is:

1. A display panel, comprising:

a substrate and a plurality of pixel circuits on the substrate, wherein each of the plurality of pixel circuits comprises:

a driving module and an organic light-emitting device, wherein the driving module is configured to provide a driving current to the organic light-emitting device, and the organic light-emitting device is configured to emit light in response to the driving current;

a data writing module configured to write a data signal into a control terminal of the driving module;

a storage module electrically connected to the control terminal of the driving module, and configured to maintain a voltage on the control terminal of the driving module in an emit-lighting phase; and a plurality of control modules each electrically connected to the control terminal of the driving module, and configured to write a signal to the control terminal of the driving module prior to the light-emitting phase, wherein the plurality of control modules each has a control transistor comprising a continuous active layer structure and a continuous gate structure, wherein the continuous gate structure comprises at least one hollowed structure, wherein a perpendicular projection of the at least one hollowed structure on the substrate partly covers a perpendicular projection of the continuous active layer structure on the substrate, and wherein a projected area of the at least one hollowed structure on the substrate is larger than a projected area of the continuous active layer structure at a position corresponding to the at least one hollowed structure on the substrate;

wherein the continuous active layer structure comprises overlapping portions with the continuous gate structure in a direction perpendicular to the substrate;

a width-to-length ratio of a channel corresponding to at least one of the overlapping portions is different from a width-to-length ratio of a channel corresponding to a different than the at least one of the overlapping portions; and wherein along a direction from a first electrode to a second electrode of the control transistor, width-to-length ratios of the channels corresponding to the different overlapping portions are monotonically decreased or increased.

2. The display panel according to claim 1, wherein a width of the channel corresponding to the overlapping portion is greater than or equal to 2 μm and less than or equal to 10 μm; and wherein a length of the channel corresponding to the overlapping portion is greater than or equal to 1.5 μm and less than or equal to 10 μm.

3. The display panel according to claim 1, wherein a number of the at least one hollowed structure of one of the control transistors is same as or different from a number of the at least one hollowed structure of another of the control transistors.

4. The display panel according to claim 1, wherein a number of the at least one hollowed structures in each of the plurality of control transistors is two or three.

5. The display panel according to claim 1, wherein the at least one hollowed structure is a through-hole structure or a groove structure.

6. The display panel according to claim 1, wherein one of the plurality of control modules is a threshold voltage compensation module, and the control transistor is a threshold voltage compensation transistor;

wherein one of the plurality of pixel circuits further comprises a first light-emitting control module and a second light-emitting control module;

wherein a control terminal of the data writing module is electrically connected to a first scan signal input terminal, a first terminal thereof is electrically connected to the data signal input terminal, and a second terminal thereof is electrically connected to a first terminal of the driving module;

wherein a control terminal of the threshold voltage compensation module is electrically connected to the first scan signal input terminal, a first terminal thereof is electrically connected to a second terminal of the driving module, and a second terminal thereof is electrically connected to the control terminal of the driving module;

wherein a control terminal of the first light-emitting control module is electrically connected to an enable signal input terminal, a first terminal thereof is electrically connected to a first power signal input terminal, and a second terminal thereof is electrically connected to the first terminal of the driving module;

wherein a control terminal of the second light-emitting control module is electrically connected to the enable signal input terminal, a first terminal thereof is electrically connected to the second terminal of the driving module, the second terminal thereof is electrically connected to a first electrode of the organic light-emitting device;

wherein a second electrode of the organic light-emitting device is electrically connected to a second power signal input terminal; and wherein a first terminal of the storage module is electrically connected to the control terminal of the driving module and a second terminal thereof is electrically connected to the first power signal input terminal for capturing the threshold voltage of the driving module and compensating the threshold voltage of the driving module, so that the driving current flowing through the organic light-emitting device in the light-emitting phase is independent of the threshold voltage of the driving module.

7. The display panel of claim 6, wherein one of the plurality of control modules is an initialization module, and the control transistor is an initialization transistor; and wherein a control terminal of the initialization module is electrically connected to a second scan signal input terminal, a first terminal thereof is electrically connected to a reference voltage signal input terminal, and a second terminal thereof is electrically connected to the control terminal of the driving module.

8. The display panel of claim 7, wherein the pixel circuit further comprises a bypass module, wherein a control terminal of the bypass module is electrically connected to the second scan signal input terminal, a first terminal thereof is electrically connected to the first electrode of the organic light-emitting device, and a second terminal thereof is electrically connected to the reference voltage signal input terminal.

9. The display panel according to claim 7, wherein the data writing module comprises a data writing transistor, the driving module comprises a driving transistor, the first light-emitting control module comprises a first light-emitting control transistor, the second light-emitting module comprises a second light-emitting control transistor, the bypass module comprises a bypass transistor, and the storage module comprises a storage capacitor;

wherein a gate electrode of the initialization transistor is electrically connected to the second scan signal input terminal, a first electrode thereof is electrically connected to the reference voltage signal input terminal, and a second electrode thereof is electrically connected to a gate electrode of the driving transistor;

wherein a gate electrode of the data writing transistor is electrically connected to the first scan signal input terminal, a first electrode thereof is electrically connected to the data signal input terminal, and a second electrode thereof is electrically connected to a first electrode of the driving transistor;

wherein a gate electrode of the threshold voltage compensation transistor is electrically connected to the first scan signal input terminal, a first electrode thereof is electrically connected to a second electrode of the driving transistor, and a second electrode thereof is electrically connected to the gate electrode of the driving transistor;

wherein a gate electrode of the first light-emitting control transistor is electrically connected to the enable signal input terminal, a first electrode thereof is electrically connected to the first power signal input terminal, and a second electrode thereof is electrically connected to the first electrode of the driving transistor;

wherein a gate electrode of the second light-emitting control transistor is electrically connected to the enable signal input terminal, a first electrode thereof is electrically connected to a second electrode of the driving transistor, a second electrode thereof is electrically connected to a first electrode of the organic light-emitting device;

wherein a gate electrode of the bypass transistor is electrically connected to the second scan signal input terminal, a first electrode thereof is electrically connected to the first electrode of the organic light-emitting device, and a second electrode thereof is electrically connected to the reference voltage signal input terminal; and wherein a first electrode of the storage capacitor is electrically connected to the gate electrode of the driving transistor, and a second electrode thereof is electrically connected to the first power signal input terminal.

10. The display panel according to claim 9, wherein each of the initialization transistor, the data writing transistor, the threshold voltage compensation transistor, the driving transistor, the first light-emitting control transistor, and the second light-emitting control transistor and the bypass transistor is a P-type transistor or a N-type transistor.

11. A display device, comprising a display panel, wherein the display panel comprises:

a substrate and a plurality of pixel circuits on the substrate, wherein each of the plurality of pixel circuits comprises:

a driving module and an organic light-emitting device, wherein the driving module is configured to provide a driving current to the organic light-emitting device, and the organic light-emitting device is configured to emit light in response to the driving current;

a data writing module configured to write a data signal into a control terminal of the driving module;

a storage module electrically connected to the control terminal of the driving module, and configured to maintain a voltage on the control terminal of the driving module in an emit-lighting phase; and a plurality of control modules each electrically connected to the control terminal of the driving module, and configured to write a signal to the control terminal of the driving module prior to the light-emitting phase, wherein the plurality of control modules each has a control transistor comprising a continuous active layer structure and a continuous gate structure, wherein the continuous gate structure comprises at least one hollowed structure, wherein a perpendicular projection of the hollowed structure on the substrate partly covers a perpendicular projection of the continuous active layer structure on the substrate, and wherein a projected area of the hollowed structure on the substrate is larger than a projected area of the continuous active layer structure at a position corresponding to the hollowed structure on the substrate;

wherein the continuous active layer structure comprises overlapping portions with the continuous gate structure in a direction perpendicular to the substrate;

a width-to-length ratio of a channel corresponding to at least one of the overlapping portions is different from a width-to-length ratio of a channel corresponding to a difference than the at least one of the overlapping portions; and wherein along a direction from a first electrode to a second electrode of the control transistor, width-to-length ratios of the channels corresponding to different overlapping portions are monotonically decreased or increased.

12. The display device according to claim 11, wherein a number of the at least one hollowed structure of the control transistor is same as or different from a number of the at least one hollowed structures of the other control transistors.

13. The display device according to claim 11, wherein a number of the at least one hollowed structures in the control transistors is two or three.

14. The display device according to claim 11, wherein the at least one hollowed structure is a through-hole structure or a groove structure.

15. The display device according to claim 11, wherein one of the plurality of control modules is a threshold voltage compensation module, and the control transistor is a threshold voltage compensation transistor;

wherein one of the plurality of pixel circuits further comprises a first light-emitting control module and a second light-emitting control module;

wherein a control terminal of the data writing module is electrically connected to a first scan signal input terminal, a first terminal thereof is electrically connected to the data signal input terminal, and a second terminal thereof is electrically connected to a first terminal of the driving module;

wherein a control terminal of the threshold voltage compensation module is electrically connected to the first scan signal input terminal, a first terminal thereof is electrically connected to a second terminal of the driving module, and a second terminal thereof is electrically connected to the control terminal of the driving module;

wherein a control terminal of the first light-emitting control module is electrically connected to an enable signal input terminal, a first terminal thereof is electrically connected to a first power signal input terminal, and a second terminal thereof is electrically connected to the first terminal of the driving module;

wherein a control terminal of the second light-emitting control module is electrically connected to the enable signal input terminal, a first terminal thereof is electrically connected to the second terminal of the driving module, the second terminal thereof is electrically connected to a first electrode of the organic light-emitting device;

wherein a second electrode of the organic light-emitting device is electrically connected to a second power signal input terminal; and wherein a first terminal of the storage module is electrically connected to the control terminal of the driving module and a second terminal thereof is electrically connected to the first power signal input terminal for capturing the threshold voltage of the driving module and compensating the threshold voltage of the driving module, so that the driving current flowing through the organic light-emitting device in the light-emitting phase is independent of the threshold voltage of the driving module.

16. The display device according to claim 11, wherein a width of the channel corresponding to the overlapping portions is greater than or equal to 2 μm and less than or equal to 10 μm; and a length of the channel corresponding to the overlapping portions is greater than or equal to 1.5 μm and less than or equal to 10 μm.

17. A display panel, comprising: a substrate and a plurality of pixel circuits on the substrate, wherein each of the plurality of pixel circuits comprises: a driving module and an organic light-emitting device, wherein the driving module is configured to provide a driving current to the organic light-emitting device, and the organic light-emitting device is configured to emit light in response to the driving current; a data writing module configured to write a data signal into a control terminal of the driving module; a storage module electrically connected to the control terminal of the driving module, and configured to maintain a voltage on the control terminal of the driving module in an emit-lighting phase; and a plurality of control modules each electrically connected to the control terminal of the driving module, and configured to write a signal to the control terminal of the driving module prior to the light-emitting phase, wherein the plurality of control modules each has a control transistor comprising a continuous active layer structure and a continuous gate structure, wherein the continuous gate structure comprises at least one hollowed structure, wherein a perpendicular projection of the at least one hollowed structure on the substrate partly covers a perpendicular projection of the continuous active layer structure on the substrate, and wherein a projected area of the at least one hollowed structure on the substrate is larger than a projected area of the continuous active layer structure at a position corresponding to the at least one hollowed structure on the substrate; wherein the control transistor comprises three sub-transistors, and the continuous active layer structure comprises overlapping portions with the continuous gate structure in a direction perpendicular to the substrate; and wherein width-to-length ratios of channels of the three sub-transistors are set to reduce in a 3:2:1 ratio relative to each other.

* * * * *